US007651411B2

(12) United States Patent
Jones

(10) Patent No.: US 7,651,411 B2
(45) Date of Patent: Jan. 26, 2010

(54) GOLF PUTTER HEAD WITH INCREASED PERIMETER WEIGHTING

(75) Inventor: David D. Jones, Glendale, AZ (US)

(73) Assignee: Karsten Manufacturing Corporation, Phoenix, AZ (US)

( * ) Notice: Subject to any disclaimer, the term of this patent is extended or adjusted under 35 U.S.C. 154(b) by 99 days.

(21) Appl. No.: 11/373,549

(22) Filed: Mar. 10, 2006

(65) Prior Publication Data

US 2007/0213141 A1 Sep. 13, 2007

(51) Int. Cl.
*A63B 53/04* (2006.01)

(52) U.S. Cl. ..... 473/341; 473/350

(58) Field of Classification Search ..... 473/324–350, 473/251, 313

See application file for complete search history.

(56) References Cited

U.S. PATENT DOCUMENTS

| | | | | | |
|---|---|---|---|---|---|
| 3,966,210 | A | | 6/1976 | Rozmus | |
| 4,010,958 | A | | 3/1977 | Long | |
| 4,871,174 | A | * | 10/1989 | Kobayashi | 473/252 |
| 5,072,941 | A | * | 12/1991 | Klein | 473/255 |
| 5,080,365 | A | * | 1/1992 | Winchell | 473/255 |
| 5,482,281 | A | | 1/1996 | Anderson | |
| 5,830,078 | A | | 11/1998 | McMahan | |
| 5,842,935 | A | | 12/1998 | Nelson | |
| 6,471,600 | B2 | | 10/2002 | Tang et al. | |
| D486,540 | S | * | 2/2004 | Bettinardi | D21/738 |
| 6,837,801 | B1 | | 1/2005 | Souza et al. | |
| 6,926,615 | B1 | | 8/2005 | Souza et al. | |
| 6,929,564 | B2 | * | 8/2005 | Olsavsky et al. | 473/340 |
| 6,960,140 | B2 | | 11/2005 | Solheim et al. | |
| 6,966,845 | B2 | | 11/2005 | Solheim et al. | |
| 7,374,497 | B2 | * | 5/2008 | Brown | 473/251 |
| 2004/0132542 | A1 | * | 7/2004 | Olsavsky et al. | 473/336 |

FOREIGN PATENT DOCUMENTS

| | | | |
|---|---|---|---|
| GB | 2407779 | A * | 5/2005 |
| JP | 2005211613 | A * | 8/2005 |

* cited by examiner

*Primary Examiner*—Alvin A Hunter

(57) ABSTRACT

A golf putter head includes a face member arranged for impacting a golf ball. A first rear mass is located substantially rearward of a heel end of the face member, and a second rear mass is located substantially rearward of a toe end of the face member. Upper and lower arms extend rearwardly from the face member connecting the face member to the first and second rear masses. A cavity is defined between the upper and lower arms, and three openings to the cavity are provided. One of the openings is located between the first and second rear masses. Another opening is located between the first rear mass and the face member, and a further opening is located between the second rear mass and the face member.

24 Claims, 5 Drawing Sheets

GOLF PUTTER HEAD WITH INCREASED PERIMETER WEIGHTING

BACKGROUND OF THE INVENTION

This invention relates generally to golf equipment and, in particular, to a golf putter head with increased perimeter weighting.

Recent developments in golf equipment have resulted in putters with heads that have higher moments of inertia. For example, U.S. Pat. No. 5,482,281 to D. W. Anderson discloses a putter head sold under the name DANSER. The Anderson putter head has heel and toe weights mounted on a lower plate-like member. The heel and toe weights and the lower plate-like member are preferably made of dense material such as bronze or steel. An upper shell-like member, preferably made of lower density material such as plastic or aluminum, is secured to the lower plate-like material to enclose the heel and toe masses. U.S. Pat. No. 5,842,935 to M. J. Nelson discloses a putter head sold under the name NELLI. The Nelson putter head has a horseshoe shaped body formed of high density material such as steel with thickened heel and toe portions. The horseshoe shaped body includes a cavity which receives an insert formed of low density material such as polyurethane. The insert preferably constitutes about 15 percent of the total mass of the putter head while constituting more than 50 percent of the total volume of the putter head. Further, U.S. Pat. No. 6,960,140 to J. A. Solheim et al discloses a putter head sold under the name CRAZE. The Solheim putter head includes a central member connected to a face member. The central member has a thickened portion located rearward of the face member, and a pair of arms extend rearward from heel and toe ends of the face member.

SUMMARY OF THE INVENTION

The present invention provides a golf putter head including a face member arranged for impacting a golf ball, the face member having a heel end and a toe end. A first rear mass is located substantially rearward of the heel end, and a second rear mass is located substantially rearward of the toe end. Upper and lower arms extend rearwardly from the face member connecting the face member to the first rear mass and to the second rear mass. A cavity is defined between the upper and lower arms, and the putter head further includes an opening to the cavity located between the first and second rear masses. In the preferred embodiment, the putter head has two additional openings to the cavity. One of these additional openings is located between the first rear mass and the face member, and the other additional opening is located between second rear mass and the face member. The upper and lower arms are each generally T-shaped or Y-shaped. The upper and lower arms each have a first portion extending between the first and second rear masses, and a second portion extending between the first portion and the face member.

DESCRIPTION OF THE INVENTION

Figure 1:
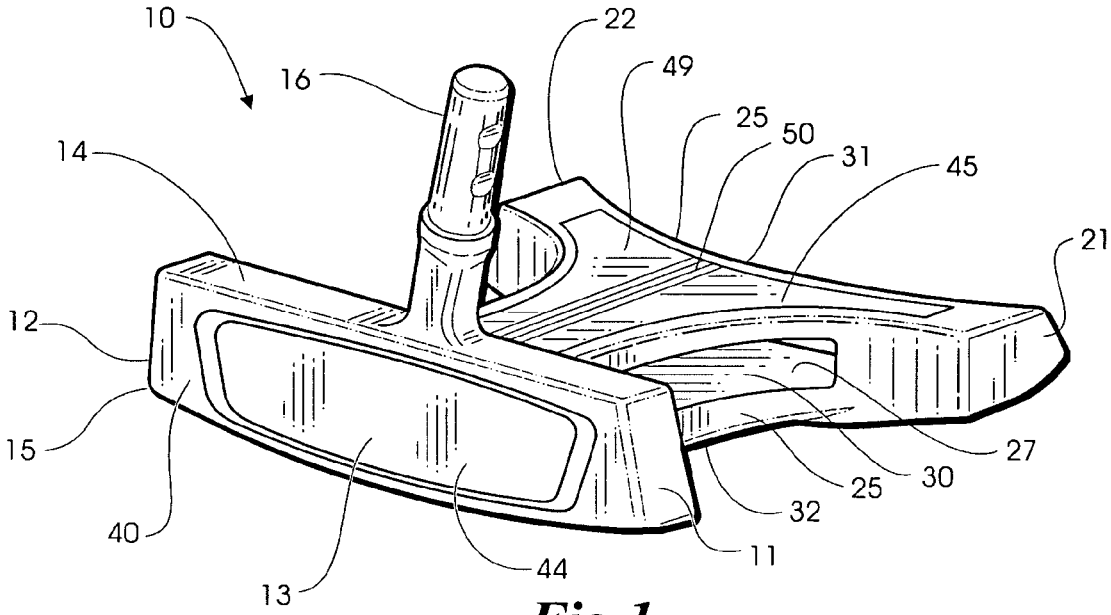
FIG. 1 is a front perspective view of a golf putter head in accordance with the invention.
Figure 2:
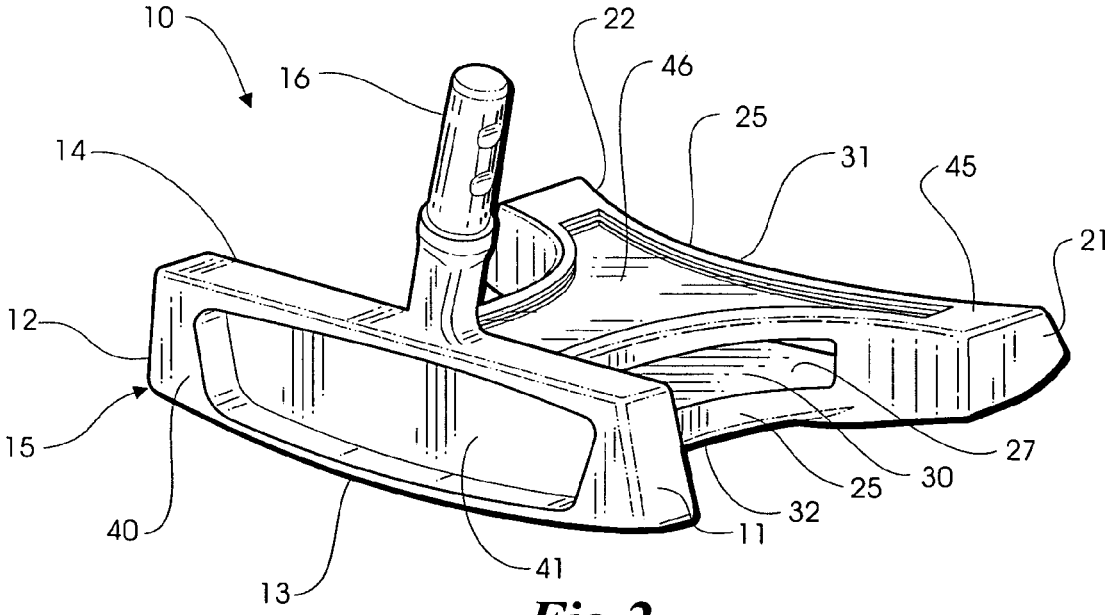
FIG. 2 is another front perspective view of the golf putter head of FIG. 1 with two parts removed.
Figure 3:
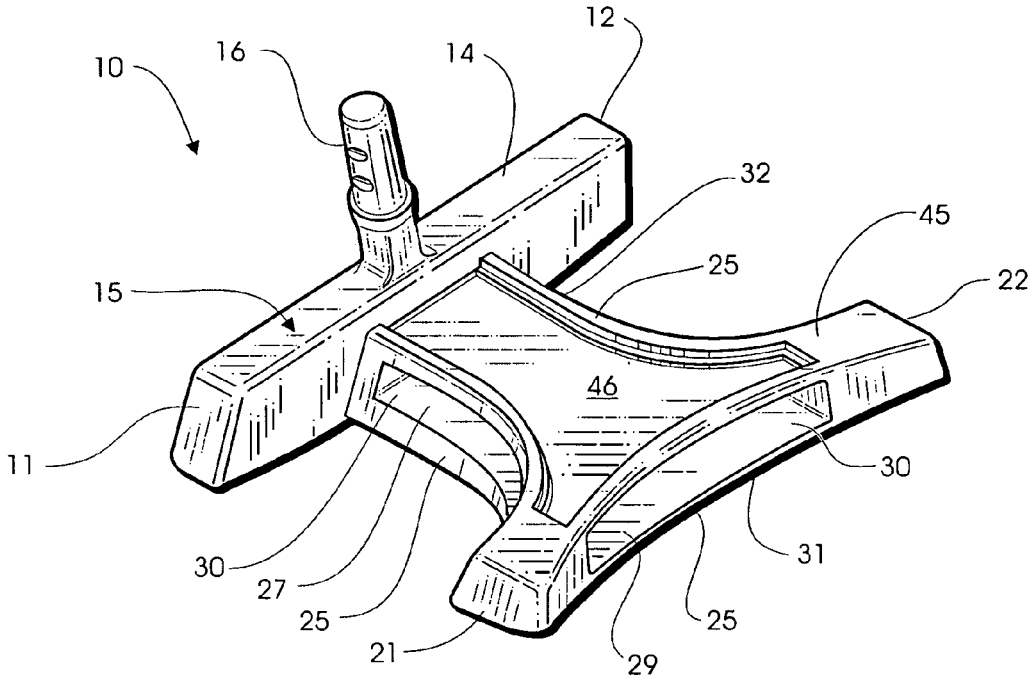
FIG. 3 is a rear perspective view of the golf putter head of FIG. 1 with two parts removed.
Figure 4:
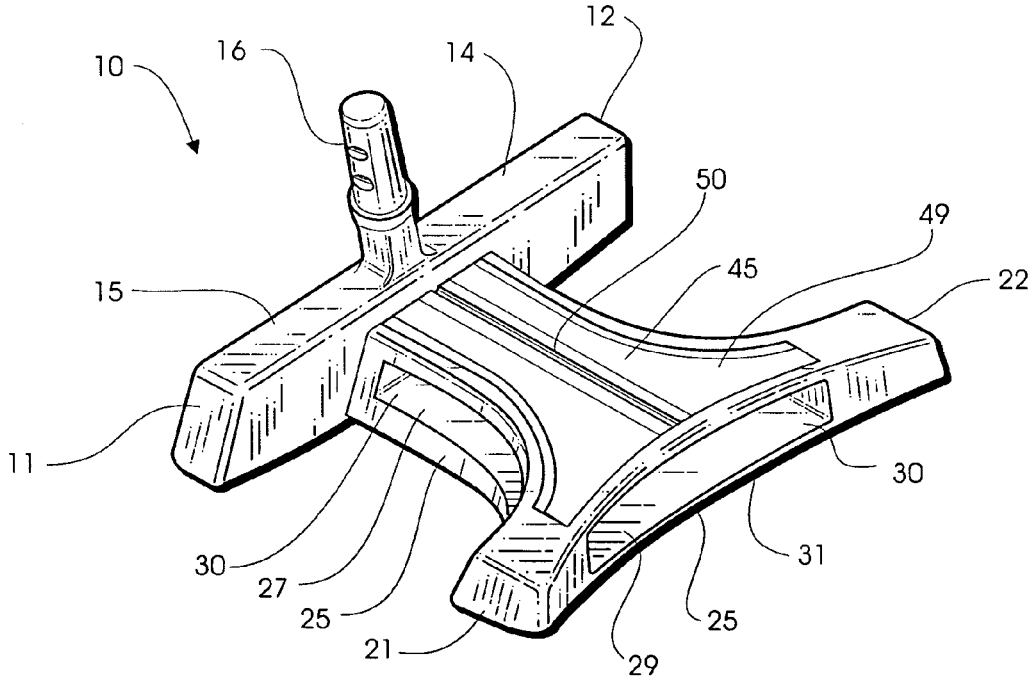
FIG. 4 is another rear perspective view of the golf putter head of FIG. 1.

FIGS. 1-9 illustrate a golf putter head 10 which includes a body 15 and two parts or inserts 44 and 49. The putter head 10 is shown in FIGS. 2 and 3 with the two inserts 44 and 49 removed. Body 15 includes a face member 14 arranged for impacting a golf ball. The face member 14 has a heel end 11 and a toe end 12. A first rear mass 21 is located substantially rearward of the heel end 11, and a second rear mass 22 is located substantially rearward of the toe end 12. Upper and lower arms 25 are spaced apart and extend rearwardly from the face member 14 connecting the face member 14 to the first rear mass 21 and to the second rear mass 22. A cavity 30 is defined between the upper and lower arms 25. Each arm 25 includes a first portion 31 extending between the first rear mass 21 and the second rear mass 22, and a second portion 32 extending between the first portion 31 and the face member 14.

Openings 27, 28, and 29 to the cavity 30 are provided between the upper and lower arms 25. Each opening 27, 28, 29 has a greater horizontal dimension than vertical dimension. Openings 27 and 28 are mirror images of each other. Opening 27 is located between the first rear mass 21 and the face member 14. Opening 28 is located between the second rear mass 22 and the face member 14. Opening 29 is located between the first and second rear masses 21, 22.

A hosel 16 is connected to the face member 14 for attachment to a shaft (not shown). Alternatively, a hole may be formed in face member 14 for receiving the shaft. Hosel 16 may be positioned relative to face member 14 so that the putter head 10 is "face-balanced" as described in U.S. Pat. No. 5,226,654 to K. Solheim.

Figure 5:
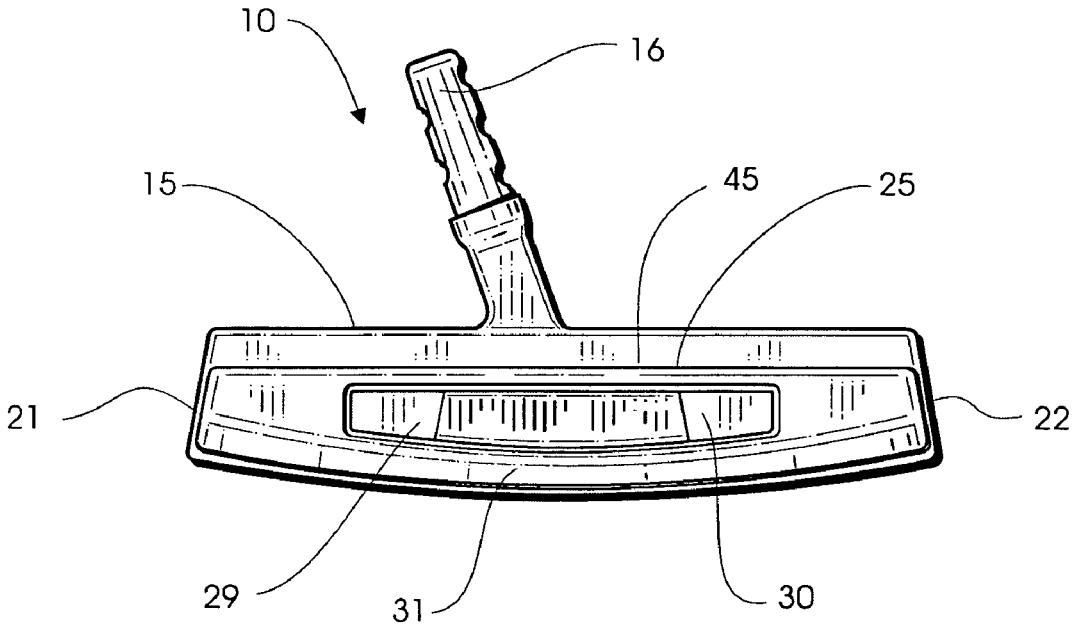
FIG. 5 is a rear elevational view of the golf putter head of FIG. 1.
Figure 6:
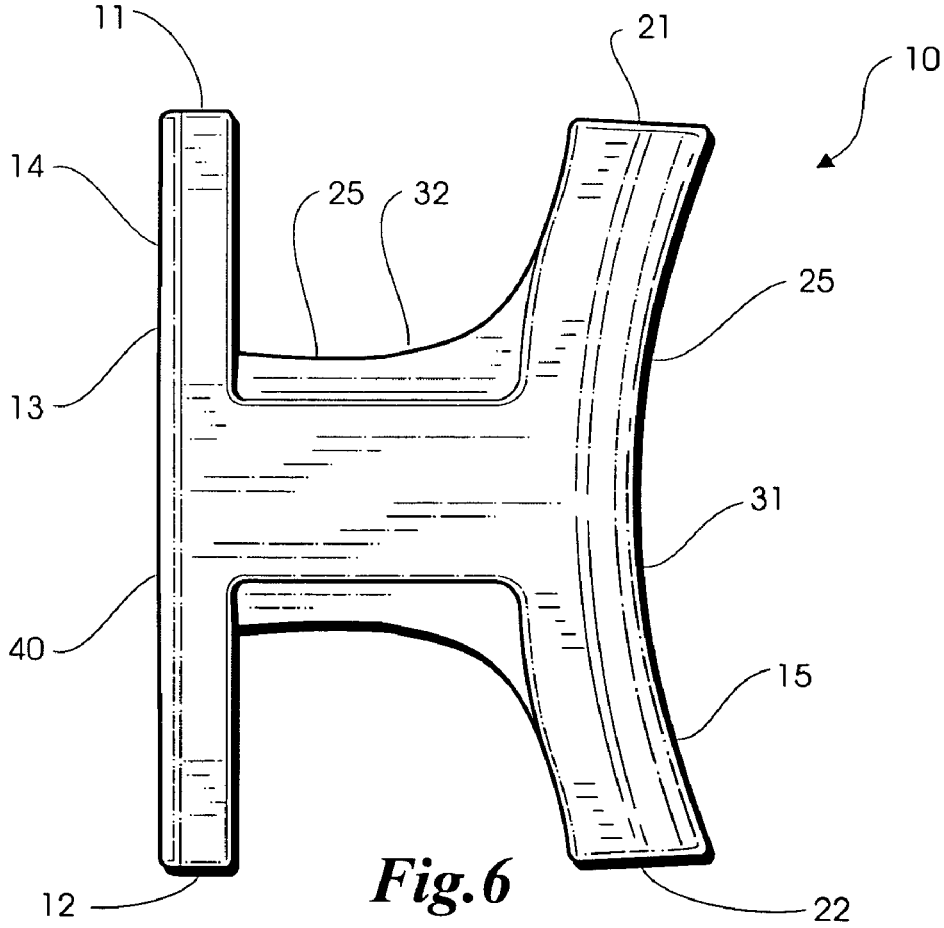
FIG. 6 is a bottom view of the golf putter head of FIG. 1.
Figure 7:
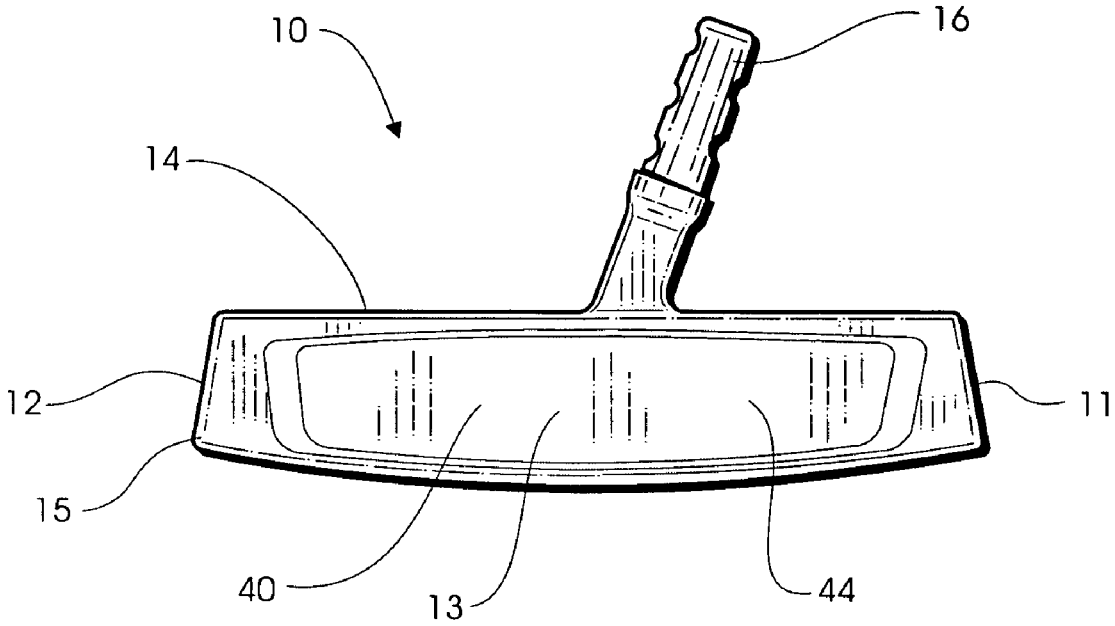
FIG. 7 is a front elevational view of the golf putter head of FIG. 1.
Figure 8:
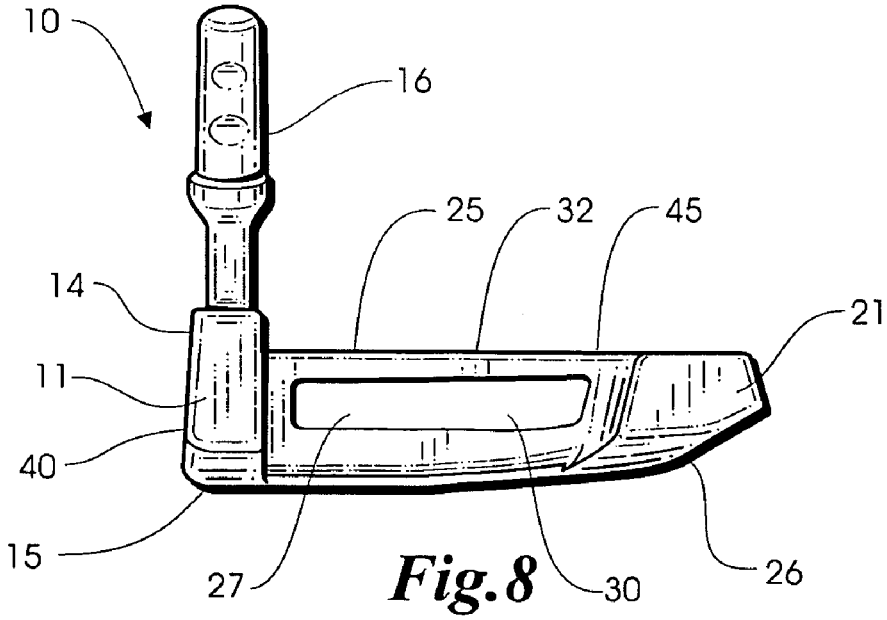
FIG. 8 is a heel end elevational view of the golf putter head of FIG. 1.
Figure 9:
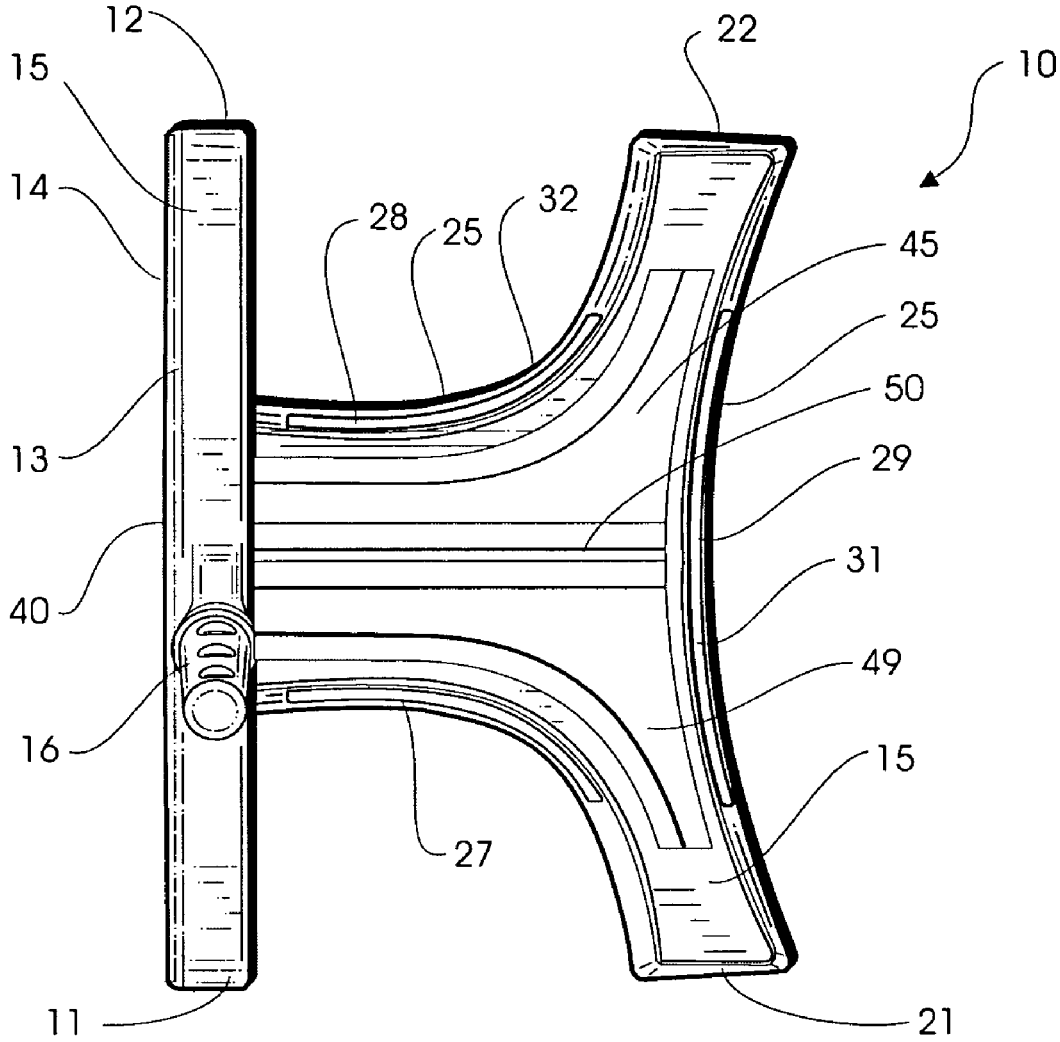
FIG. 9 is a top view of the golf putter head of FIG. 1.

As best seen in FIGS. 6 and 9, the upper and lower arms 25 are generally T-shaped or Y-shaped with the putter head 10 in its entirety being generally H-shaped or K-shaped. Both the first and second portions 31, 32 of the lower arm 25 have a convex radius of curvature as seen in FIG. 5 that significantly reduces contact between the putter head 10 and a putting surface. As shown in FIG. 8, the first portion 31 of the lower arm 25 also has a sloping trailing surface 26 to prevent the putter head 10 from catching on a putting surface during use.

Referring to FIGS. 1 and 2, the face member 14 has a striking surface 40 with a recess 41 formed therein between the heel end 11 and the toe end 12. The face insert 44 is received in the recess 41 and occupies a middle section 13 of the face member 14. The upper arm 25 includes a top surface 45 having a recess 46 formed therein. The top insert 49 received within the recess 46 includes an alignment aid 50 which extends in a direction that the putter head 10 is intended to take when being swung.

In the preferred embodiment, rear masses 21 and 22 are made of the same material as the remainder of body 15. In other embodiments, rear masses 21 and 22 may be made of or include a different material with higher density to further increase the moment of inertial of the putter head 10. For example, rear masses 21 and 22 may be made of metal while the remainder of the body 15 is made of a non-metallic material.

It will be understood that since the masses 21 and 22 are located directly behind the heel and toe ends 11, 12 of the face member 14, they provide the putter head 10 with increased perimeter weighting and an increased moment of inertia.

In an alternative embodiment (not shown), another material may completely or partially fill cavity 30. Such another material will preferably have lower density than the material forming body 15.

What is claimed is:

1. A golf putter head comprising:

a face member arranged for impacting a golf ball, the face member having a heel end and a toe end;

a first rear mass located substantially rearward of the heel end;

a second rear mass located substantially rearward of the toe end;

upper and lower arms extending rearwardly from the face member connecting the face member to the first rear mass and to the second rear mass;

a cavity defined between the upper and lower arms;

an opening to the cavity at a rear of the golf putter head, the opening being bounded by a cross sectional area of the cavity, where the cross sectional area extends from the first rear mass to the second rear mass, and the opening being located between and extending without interruption between the first and second rear masses; and two additional openings to the cavity, one of the additional openings being located between and extending without interruption between the first rear mass and the face member, and the other additional opening being located between and extending without interruption between the second rear mass and the face member.

2. The golf putter head of claim 1, wherein the upper and lower arms each comprise a first portion extending between the first and second rear masses, and a second portion extending between the first portion and the face member.

3. The golf putter head of claim 2, wherein the first and second portions of the lower arm have a convex radius of curvature.

4. The golf putter head of claim 3, wherein the first portion of the lower arm has a sloping bottom surface.

5. The golf putter head of claim 1, wherein the upper arm includes a top surface having a recess formed therein, and further comprising a top insert received within the recess.

6. The golf putter head of claim 5, wherein the top insert includes an alignment aid.

7. The golf putter head of claim 1, wherein the face member comprises a striking surface having a recess formed therein between the heel end and the toe end, and further comprising a face insert received within the recess.

8. The golf putter head of claim 1, wherein:

the opening of the cavity comprises:

a height from the upper arm to the lower arm; and a width from the first rear mass to the second rear mass;

wherein the width is greater than the height.

9. The golf putter head of claim 1, wherein:

the upper and lower arms are each T-shaped; and the first and second rear masses are located at opposite ends of the T-shape.

10. The golf putter head of claim 1, wherein:

the golf putter head is K-shaped; and the first and second rear masses are located at diagonal ends of the K-shape.

11. The golf putter head of claim 1, wherein:

the opening and the two additional openings are visible to each other via the cavity.

12. The golf putter head of claim 1, wherein:

at least one of the face member, the upper arm, or the lower arm of the golf putter head comprises a first material; and the first and second rear masses comprise the first material.

13. A golf putter head comprising:

a face member arranged for impacting a golf ball, the face member having a heel end and a toe end;

a first rear mass located substantially rearward of the heel end;

a second rear mass located substantially rearward of the toe end;

uppermost and lowermost arms extending rearwardly from the face member connecting the face member to the first rear mass and to the second rear mass, the uppermost and lowermost arms being spaced apart and defining a cavity therebetween;

a first opening to the cavity located at a rear of the golf putter head, the first opening being located between and extending without interruption between the first and second rear masses;

a second opening to the cavity delimited by the uppermost and lowermost arms, the second opening being located between and extending without interruption between the first rear mass and the face member; and a third opening to the cavity delimited by the uppermost and lowermost arms, the third opening being located between and extending without interruption between the second rear mass and the face member.

14. The golf putter head of claim 13, wherein the uppermost arm includes a top surface having a recess formed therein, and further comprising a top insert received within the recess.

15. The golf putter head of claim 14, wherein the face member comprises a striking surface having a recess formed therein between the heel end and the toe end, and further comprising a face insert received within the recess.

16. The golf putter head of claim 15, further comprising a hosel connected to the face member.

17. The golf putter head of claim 13, wherein:

the first opening of the cavity comprises:

a first height from the uppermost arm to the lowermost arm; and a first width from the first rear mass to the second rear mass;

the second opening of the cavity comprises:

a second height from the uppermost arm to the lowermost arm; and a second width from the face member to the first rear mass;

the third opening of the cavity comprises:

a third height from the uppermost arm to the lowermost arm; and a third width from the face member to the second rear mass;

wherein:

the first width is greater than the first height;

the second width is greater than the second height; and the third width is greater than the third height.

18. The golf putter head of claim 13, wherein:

the second and third openings are mirror images of each other.

19. The golf putter head of claim 13, wherein:

the first, second, and third openings are visible to each other via the cavity.

20. The golf putter head of claim 13, wherein:

at least one of the face member, the uppermost arm, or the lowermost arm of the golf putter head comprises a first material; and the first and second rear masses comprise the first material.

21. A golf putter head comprising:

a face member arranged for impacting a golf ball, the face member having a heel end and a toe end;

a first rear mass located substantially rearward of the heel end;

a second rear mass located substantially rearward of the toe end;

uppermost and lowermost arms extending rearwardly from the face member, each of the uppermost and lowermost arms configured to connect the face member to both of the first and second rear masses;

a cavity defined between the uppermost and lowermost arms;

a single rear opening to the cavity at a rear of the golf putter head, the single rear opening comprising a rear perimeter extending from:

the uppermost arm to the lowermost arm; and the first rear mass to the second rear mass;

a single first side opening to the cavity at a first side of the golf putter head, the single first side opening comprising a first side perimeter extending from:

the uppermost arm to the lowermost arm; and the face member to the first rear mass;

and a single second side opening to the cavity at a second side of the golf putter head, the single second side opening comprising a second side perimeter extending from:

the uppermost arm to the lowermost arm; and the face member to the second rear mass.

22. The golf putter head of claim 21, wherein:

the single rear opening, the single first side opening, and the single second side opening are visible to each other via the cavity.

23. The golf putter head of claim 21, wherein:

at least two of the rear perimeter, the first side perimeter, or the second side perimeter are mirror images of each other.

24. The golf putter head of claim 21, wherein:

at least one of the face member, the uppermost arm, or the lowermost arm of the golf putter head comprises a first material; and the first and second rear masses comprise the first material.

* * * * *